US008602229B2

(12) United States Patent
Raghunathan et al.

(10) Patent No.: US 8,602,229 B2
(45) Date of Patent: Dec. 10, 2013

(54) PORTABLE CLOTHESLINE ASSEMBLY

(76) Inventors: Balaji Raghunathan, Foothill Ranch, CA (US); Francois Lindsay, Foothill Ranch, CA (US)

( * ) Notice: Subject to any disclaimer, the term of this patent is extended or adjusted under 35 U.S.C. 154(b) by 113 days.

(21) Appl. No.: 13/356,948

(22) Filed: Jan. 24, 2012

(65) Prior Publication Data

US 2013/0186846 A1 Jul. 25, 2013

(51) Int. Cl.
*D06F 53/04* (2006.01)
*D06F 57/04* (2006.01)
*D06F 57/08* (2006.01)

(52) U.S. Cl.
USPC ..... 211/119.01; 211/85.24; 211/200

(58) Field of Classification Search
USPC ..... 211/119.01, 198, 200, 201, 202, 203, 211/204, 206, 195, 85.24, 197; 248/164, 248/431, 277.1, 353, 166, 436, 439, 440; 135/121, 151, 145
See application file for complete search history.

(56) References Cited

U.S. PATENT DOCUMENTS

| | | | | | |
|---|---|---|---|---|---|
| 115,461 | A | * | 5/1871 | Goodale et al. | 211/202 |
| 490,380 | A | * | 1/1893 | Ward | 211/195 |
| 719,186 | A | * | 1/1903 | Champ | 211/202 |
| 892,413 | A | * | 7/1908 | Freeman | 211/49.1 |
| 926,813 | A | * | 7/1909 | Leen | 211/195 |
| 2,020,766 | A | * | 11/1935 | Brown | 280/639 |
| 2,388,637 | A | * | 11/1945 | John | 211/170 |
| 2,491,827 | A | * | 12/1949 | Morello | 269/305 |
| 2,558,410 | A | * | 6/1951 | Andersen | 211/119.01 |
| 3,086,740 | A | * | 4/1963 | Hatton | 248/166 |
| 3,240,505 | A | * | 3/1966 | Schlernitzauer | 280/651 |
| 3,584,745 | A | | 6/1971 | Wrightson | |
| 3,647,073 | A | | 3/1972 | Steiner | |
| 3,918,591 | A | * | 11/1975 | Cooper | 211/204 |
| 4,434,898 | A | | 3/1984 | McCarthy | |
| 5,372,266 | A | | 12/1994 | Fisher | |
| 5,449,075 | A | | 9/1995 | Meade et al. | |
| D402,187 | S | | 12/1998 | Caudle | |
| 7,104,412 | B2 | * | 9/2006 | Yong | 211/206 |
| D546,013 | S | * | 7/2007 | Pong | D32/58 |
| 7,717,391 | B2 | * | 5/2010 | Roberts | 248/353 |
| 7,946,434 | B1 | * | 5/2011 | Greenspon | 211/85.3 |
| 8,100,274 | B2 | * | 1/2012 | Trowsdale et al. | 211/195 |
| 2005/0056606 | A1 | * | 3/2005 | Tsai | 211/195 |
| 2008/0035593 | A1 | | 2/2008 | Roberts | |
| 2008/0185358 | A1 | * | 8/2008 | Hernandez | 211/195 |
| 2009/0178990 | A1 | * | 7/2009 | Trowsdale et al. | 211/183 |
| 2009/0184073 | A1 | * | 7/2009 | Lu | 211/85.3 |
| 2013/0062296 | A1 | * | 3/2013 | Roberts et al. | 211/119.01 |

* cited by examiner

*Primary Examiner* — Jennifer E Novosad

(57) ABSTRACT

A portable clothesline assembly is provided for facilitating hanging of clothes at a selectable location. The assembly includes a first stand, a second stand, and a scissor arm having a first end coupled to the first stand and a second end coupled to the second stand. A first boom arm coupled to the first stand and a second boom arm coupled to the second stand. A line is coupled to and extends between the first boom arm and the second boom arm.

20 Claims, 5 Drawing Sheets

PORTABLE CLOTHESLINE ASSEMBLY

BACKGROUND OF THE DISCLOSURE

Field of the Disclosure

The disclosure relates to clothesline devices and more particularly pertains to a new clothesline device for facilitating hanging of clothes at a selectable location.

SUMMARY OF THE DISCLOSURE

An embodiment of the disclosure meets the needs presented above by generally comprising a first stand, a second stand, and a scissor arm having a first end coupled to the first stand and a second end coupled to the second stand. A first boom arm coupled to the first stand and a second boom arm coupled to the second stand. A line is coupled to and extends between the first boom arm and the second boom arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
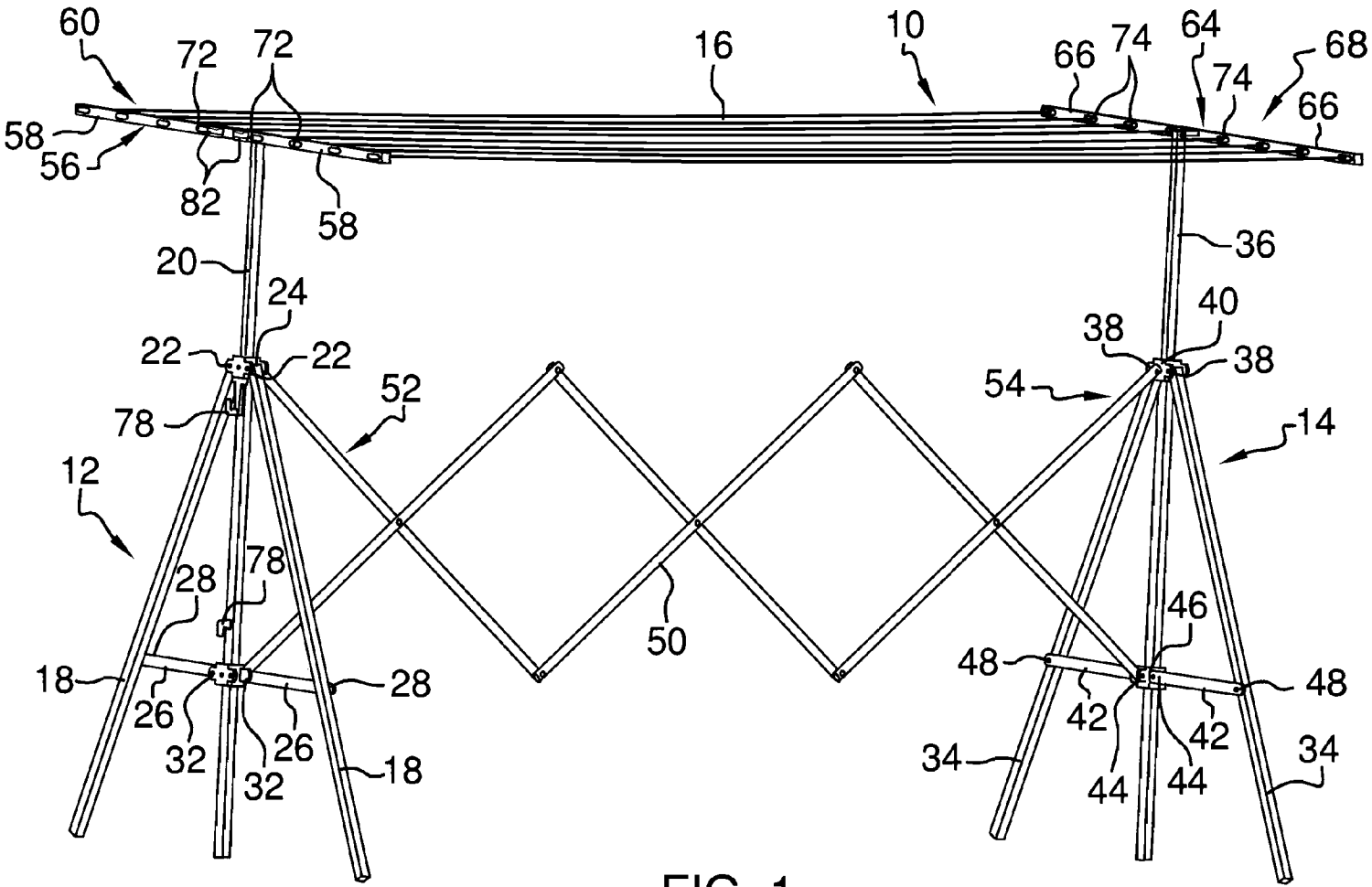
FIG. 1 is a top front side perspective view of a portable clothesline assembly according to an embodiment of the disclosure.
Figure 2:
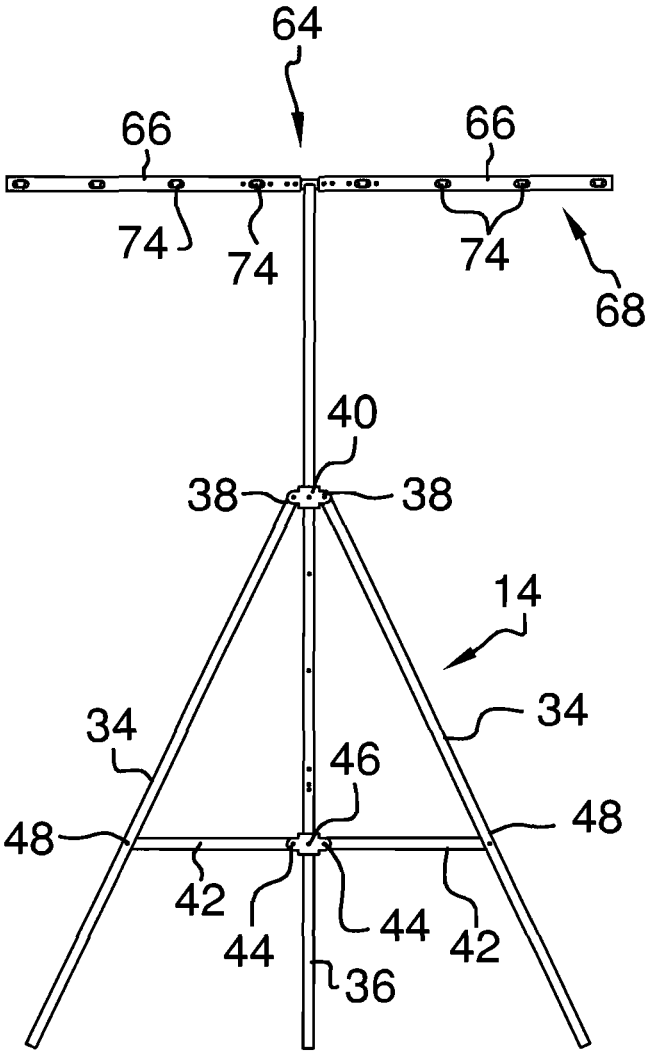
FIG. 2 is a front view of an embodiment of the disclosure.
Figure 3:
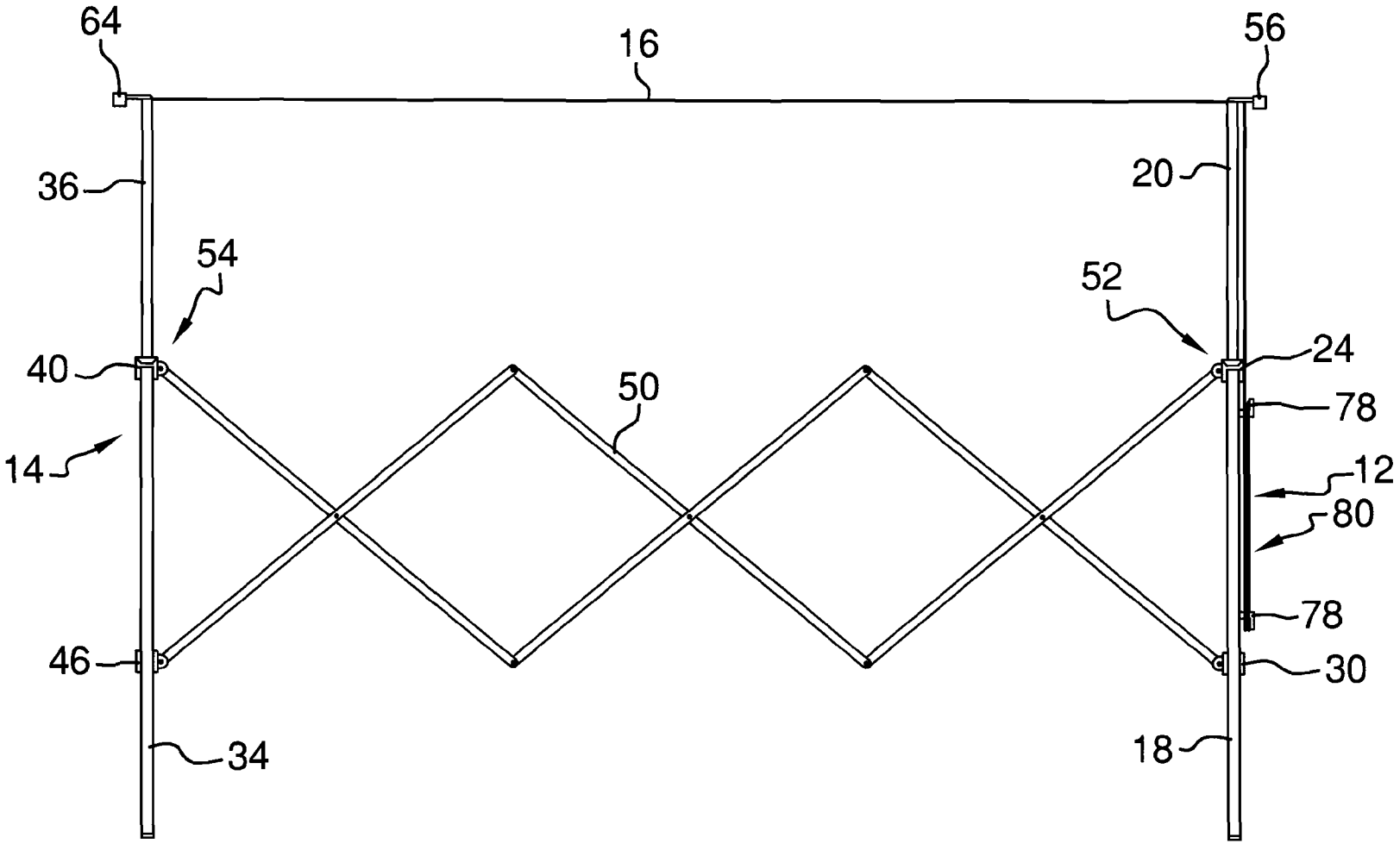
FIG. 3 is a side view of an embodiment of the disclosure.
Figure 4:
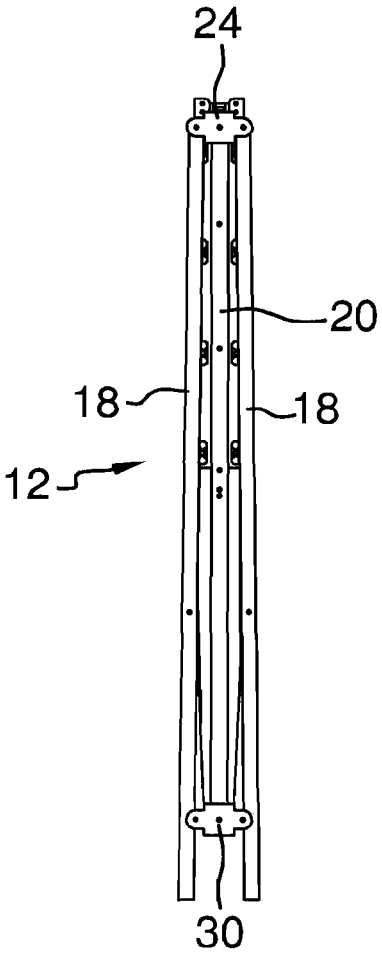
FIG. 4 is a front view of an embodiment of the disclosure in a collapsed position.
Figure 5:
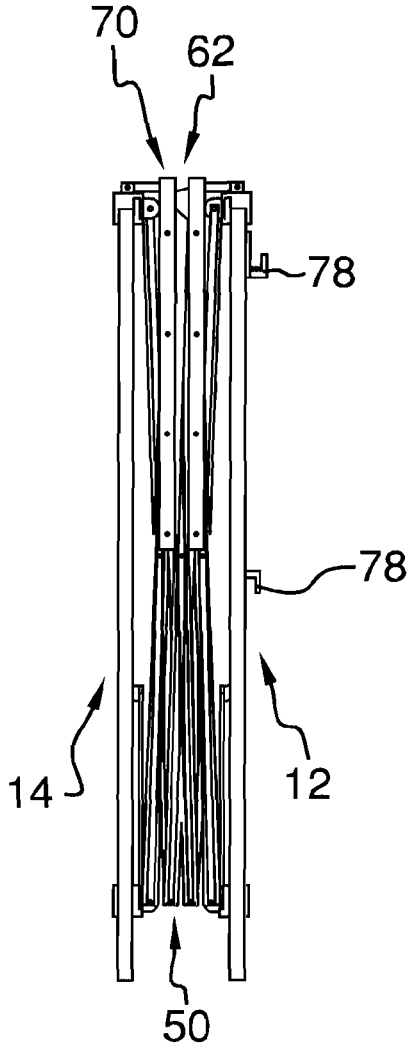
FIG. 5 is a side view of an embodiment of the disclosure in a collapsed position.
Figure 6:
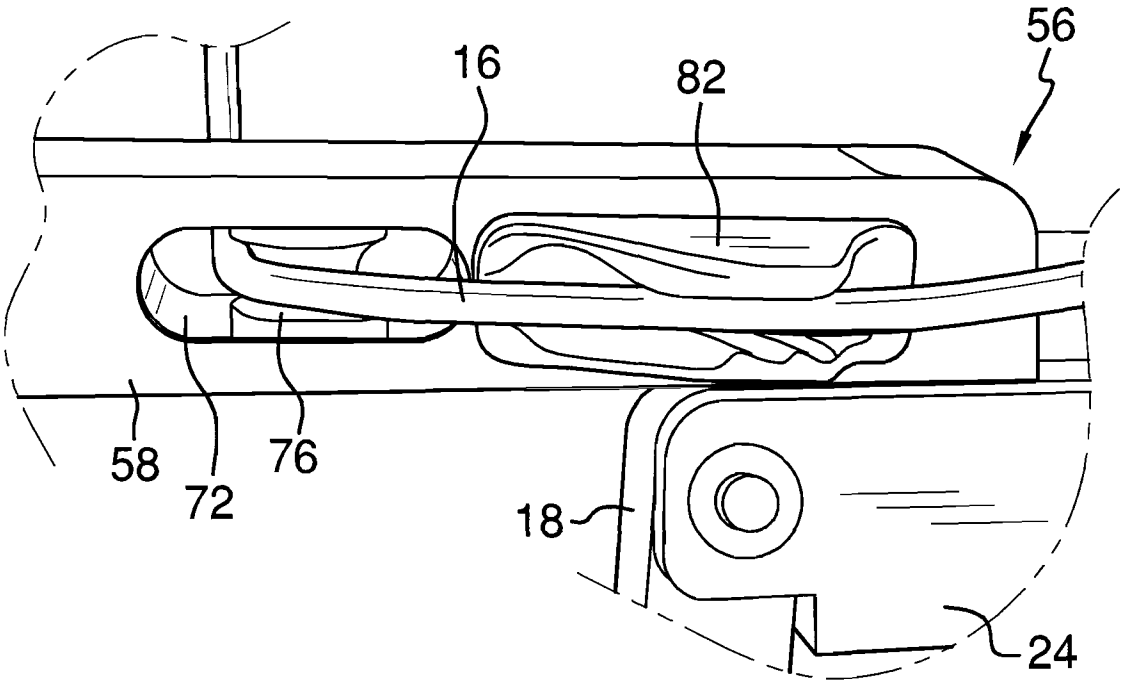
FIG. 6 is a detail view of an embodiment of the disclosure.

With reference now to the drawings, and in particular to FIGS. 1 through 6 thereof, a new clothesline device embodying the principles and concepts of an embodiment of the disclosure and generally designated by the reference numeral 10 will be described.

As best illustrated in FIGS. 1 through 6, the portable clothesline assembly 10 generally comprises a collapsible first stand 12, a collapsible second stand 14, and a line 16 extending between the first stand 12 and the second stand 14. The first stand 12 includes a plurality of legs 18 coupled to a telescopic mast 20. The legs 18 of the first stand 12 have upper ends 22 pivotally coupled to an upper mast head 24 coupled to the mast 20 of the first stand 12. The first stand 12 further includes a pair of brace arms 26. Each brace arm 26 of the first stand 12 has a first end 28 pivotally coupled to an associated one of the legs 18 of the first stand 12. The first stand 12 includes a lower mast head 30 coupled to the mast 20 of the first stand 12. Each brace arm 26 of the first stand 12 has a second end 32 coupled to the lower mast head 30 of the first stand 12. The lower mast head 30 is slidable on the mast 20 of the first stand 12.

The second stand 14 also has a plurality of legs 34 coupled to a telescopic mast 36. The legs 34 of the second stand 14 have upper ends 38 pivotally coupled to an upper mast head 40 coupled to the mast 36 of the second stand 14. The second stand 14 includes a pair of brace arms 42. Each brace arm 42 of the second stand 14 has a first end 44 pivotally coupled to an associated one of the legs 34 of the second stand 14. The second stand 14 also includes a lower mast head 46 coupled to the mast 36 of the second stand 14. Each brace arm 42 of the second stand 14 also has a second end 48 coupled to the lower mast head 46 of the second stand 14. The lower mast head 46 is slidable on the mast 36 of the second stand 14. A scissor arm 50 has a first end 52 coupled to the first stand 12 and a second end 54 coupled to the second stand 14.

A first boom arm 56 is coupled to the first stand 12. The first boom arm 56 has a pair of pivotal end sections 58 whereby the first boom arm 56 is pivotable between an extended position 60 and a collapsed position 62. Similarly, a second boom arm 64 is coupled to the second stand 14. The second boom arm 64 has a pair of pivotal end sections 66 whereby the second boom arm 64 is pivotable between an extended position 68 and a collapsed position 70. A plurality of spaced holes 72 is positioned in the first boom arm 56. A plurality of spaced apertures 74 is positioned in the second boom arm 64.

The line 16 is coupled to and extends between the first boom arm 56 and the second boom arm 64. The line 16 passes through the holes 72 and the apertures 74 to extend between the first boom arm 56 and the second boom arm 64 multiple times. Rollers 76 may be positioned in each of the holes 72 and apertures 74 to facilitate movement and tightening of the line 16. A pair of spaced hooks 78 is coupled to the mast 20 of the first stand 12. A medial portion 80 of the line 16 is wrapped around and extends between the spaced hooks 78. A pair of cleats 82 is coupled to the first boom arm 56. Each cleat 82 is coupled to the first boom arm 56 on opposite sides adjacent to the mast 20 of the first stand 12. The line 16 is selectively engaged to each cleat 82 whereby the line 16 extends tautly between the first boom arm 56 and the second boom arm 64.

In use, the first stand 12 and the second stand 14 are expanded and moved away from each other to expand the scissor arm 50. The first boom arm 56 and second boom arm 64 are pivoted upwardly and held in position either mechanically or by tension in the line 16. The line 16 is held in tension by insertion into the cleats 82. Excess portions of line 16 may be wrapped around the hooks 78.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A portable clothesline assembly comprising:

a first stand, said first stand having a plurality of legs coupled to a mast, said legs of said first stand having upper ends pivotally coupled to an upper mast head coupled to said mast of said first stand;

a second stand;

a scissor arm having a first end coupled to said first stand and a second end coupled to said second stand;

a first boom arm coupled to said first stand;

a second boom arm coupled to said second stand; and a line coupled to and extending between said first boom arm and said second boom arm.

2. The assembly of claim 1, further including said first stand being collapsible.

3. The assembly of claim 1, further including said second stand being collapsible.

4. The assembly of claim 1, further including said mast of said first stand being telescopic.

5. The assembly of claim 1, further comprising:

said first stand including a pair of brace arms, each brace arm of said first stand having a first end pivotally coupled to an associated one of said legs of said first stand; and said first stand including a lower mast head coupled to said mast of said first stand, each brace arm of said first stand having a second end coupled to said lower mast head of said first stand, said lower mast head being slidable on said mast of said first stand.

6. The assembly of claim 1, further including a pair of spaced hooks coupled to said mast of said first stand.

7. The assembly of claim 6, further comprising:

a plurality of spaced holes positioned in said first boom arm;

a plurality of spaced apertures positioned in said second boom arm; and said line passing through said holes and said apertures to extend between said first boom arm and said second boom arm multiple times.

8. The assembly of claim 1, further including said second stand having a plurality of legs coupled to a mast.

9. The assembly of claim 8, further including said mast of said second stand being telescopic.

10. The assembly of claim 8, further including said legs of said second stand having upper ends pivotally coupled to an upper mast head coupled to said mast of said second stand.

11. The assembly of claim 10, further comprising:

said second stand including a pair of brace arms, each brace arm of said second stand having a first end pivotally coupled to an associated one of said legs of said second stand; and said second stand including a lower mast head coupled to said mast of said second stand, each brace arm of said second stand having a second end coupled to said lower mast head of said second stand, said lower mast head being slidable on said mast of said second stand.

12. The assembly of claim 1, further comprising:

said first boom arm having a pair of pivotal end sections whereby said first boom arm is pivotable between an extended position and a collapsed position; and said second boom arm having a pair of pivotal end sections whereby said second boom arm is pivotable between an extended position and a collapsed position.

13. A portable clothesline assembly comprising:

a first stand, said first stand having a plurality of legs coupled to a mast;

a second stand;

a scissor arm having a first end coupled to said first stand and a second end coupled to said second stand;

a first boom arm coupled to said first stand;

a second boom arm coupled to said second stand;

a line coupled to and extending between said first boom arm and said second boom arm;

a pair of spaced hooks coupled to said mast of said first stand;

a plurality of spaced holes positioned in said first boom arm;

a plurality of spaced apertures positioned in said second boom arm;

said line passing through said holes and said apertures to extend between said first boom arm and said second boom arm multiple times;

a medial portion of said line being wrapped around and extending between said spaced hooks.

14. The assembly of claim 13, further including a pair of cleats coupled to said first boom arm, each cleat being coupled to said first boom arm on opposite sides adjacent to said mast of said first stand, said line being engaged to each cleat whereby said line extends tautly between said first boom arm and said second boom arm.

15. The assembly of claim 13, further including said first stand being collapsible.

16. The assembly of claim 13, further including said second stand being collapsible.

17. The assembly of claim 13, further including said mast of said first stand being telescopic.

18. The assembly of claim 13, further including said second stand having a plurality of legs coupled to a mast.

19. The assembly of claim 13, further comprising:

said first boom arm having a pair of pivotal end sections whereby said first boom arm is pivotable between an extended position and a collapsed position; and said second boom arm having a pair of pivotal end sections whereby said second boom arm is pivotable between an extended position and a collapsed position.

20. A portable clothesline assembly comprising:

a collapsible first stand, said first stand having a plurality of legs coupled to a mast, said mast of said first stand being telescopic, said legs of said first stand having upper ends pivotally coupled to an upper mast head coupled to said mast of said first stand, said first stand including a pair of brace arms, each brace arm of said first stand having a first end pivotally coupled to an associated one of said legs of said first stand, said first stand including a lower mast head coupled to said mast of said first stand, each brace arm of said first stand having a second end coupled to said lower mast head of said first stand, said lower mast head being slidable on said mast of said first stand;

a collapsible second stand, said second stand having a plurality of legs coupled to a mast, said mast of said second stand being telescopic, said legs of said second stand having upper ends pivotally coupled to an upper mast head coupled to said mast of said second stand, said second stand including a pair of brace arms, each brace arm of said second stand having a first end pivotally coupled to an associated one of said legs of said second stand, said second stand including a lower mast head coupled to said mast of said second stand, each brace arm of said second stand having a second end coupled to said lower mast head of said second stand, said lower mast head being slidable on said mast of said second stand;

a scissor arm having a first end coupled to said first stand and a second end coupled to said second stand;

a first boom arm coupled to said first stand, said first boom arm having a pair of pivotal end sections whereby said first boom arm is pivotable between an extended position and a collapsed position;

a second boom arm coupled to said second stand, said second boom arm having a pair of pivotal end sections whereby said second boom arm is pivotable between an extended position and a collapsed position;

a plurality of spaced holes positioned in said first boom arm;

a plurality of spaced apertures positioned in said second boom arm;

a line coupled to and extending between said first boom arm and said second boom arm, said line passing through said holes and said apertures to extend between said first boom arm and said second boom arm multiple times;

a pair of spaced hooks coupled to said mast of said first stand;

a medial portion of said line being wrapped around and extending between said spaced hooks; and a pair of cleats coupled to said first boom arm, each cleat being coupled to said first boom arm on opposite sides adjacent to said mast of said first stand, said line being engaged to each cleat whereby said line extends tautly between said first boom arm and said second boom arm.

* * * * *